United States Patent [19]

Frank et al.

[11] Patent Number: 5,036,978

[45] **Date of Patent: * Aug. 6, 1991**

[54] OPENING DEVICE FOR FLEXIBLE BAGS FILLED WITH COMPRESSED FLEXIBLE ARTICLES

[75] Inventors: Martin Frank, Frankfurt am Main; Agustin Ramos, Eschborn, both of Fed. Rep. of Germany

[73] Assignee: The Procter & Gamble Company, Cincinnati, Ohio

[ * ] Notice: The portion of the term of this patent subsequent to Jun. 19, 2007 has been disclaimed.

[21] Appl. No.: 371,227

[22] Filed: Jun. 26, 1989

[30] Foreign Application Priority Data

Jun. 28, 1988 [GB] United Kingdom ..... 8815330

[51] Int. Cl.[5] ..... B65D 71/06

[52] U.S. Cl. ..... 206/494; 206/610; 206/628; 206/634; 383/66

[58] Field of Search ..... 206/494, 610, 628, 634; 383/8, 10, 66, 113, 116; 221/63, 302

[56] References Cited

U.S. PATENT DOCUMENTS

| | | | |
|---|---|---|---|
| D. 135,538 | 4/1943 | Kaplan . | |
| 655,998 | 8/1900 | Taylor . | |
| 1,261,612 | 4/1918 | Powers . | |
| 1,733,219 | 10/1929 | Duvall . | |
| 1,920,841 | 8/1933 | Clark | 100/14 |
| 2,011,236 | 8/1935 | Winter et al. | 206/57 |
| 2,127,118 | 8/1938 | Herbelin | 100/14 |
| 2,137,398 | 11/1938 | Helber | 221/302 |
| 2,196,185 | 4/1940 | Belcher | 229/54 |
| 2,448,819 | 9/1948 | Mitchell | 221/63 |
| 2,478,412 | 8/1949 | McMahan | 206/47 |
| 2,506,021 | 5/1950 | Holmberg | 93/93 |
| 2,693,304 | 11/1954 | Davis et al. | 226/18 |
| 2,700,459 | 1/1955 | Anspacher | 206/46 |
| 2,781,161 | 2/1957 | Adams | 229/54 |
| 3,006,119 | 10/1961 | Fingerhut | 53/24 |
| 3,012,692 | 12/1961 | Petersen | 221/63 |
| 3,044,228 | 7/1962 | Peterson | 53/24 |
| 3,056,245 | 10/1962 | Baum et al. | 53/24 |
| 3,059,387 | 10/1962 | Fasanella | 53/24 |
| 3,117,513 | 1/1964 | Burnett et al. | 100/215 |
| 3,124,298 | 3/1964 | Repko | 221/63 |
| 3,161,336 | 12/1964 | Loescher | 225/106 |
| 3,172,563 | 3/1965 | Harwood | 206/494 X |

(List continued on next page.)

FOREIGN PATENT DOCUMENTS

| | | | |
|---|---|---|---|
| 0223262 | 5/1987 | European Pat. Off. . | |
| 0258573 | 3/1988 | European Pat. Off. . | |
| 0349050 | 1/1990 | European Pat. Off. . | |
| 3102192 | 9/1982 | Fed. Rep. of Germany . | |
| 7934619.3 | 7/1985 | Fed. Rep. of Germany . | |
| 3629563 | 8/1986 | Fed. Rep. of Germany . | |
| 3642327 | 2/1988 | Fed. Rep. of Germany | 383/66 |
| 1282769 | 7/1972 | United Kingdom . | |

*Primary Examiner*—Stephen Marcus
*Assistant Examiner*—Jes F. Pascua
*Attorney, Agent, or Firm*—E. Kelly Linman; John V. Gorman; Richard C. Witte

[57] ABSTRACT

An easy-open flexible bag filled with compressed flexible articles. The bag has a substantially rectangular form after filling with the compressed flexible articles. The rectangular form comprises a pair of opposed front panels interconnected to a pair of opposed side panels which are oriented substantially perpendicular to the direction of compression of the flexible articles. A bottom panel is connected to the lowermost edges of the front panels and the side panels and a top panel is connected to the uppermost edges of the front panels and the side panels. The interconnected front panels and side panels are subject to tension induced by the compressed flexible articles. The flexible bag further includes an easy-opening device provided on one of the tensioned side panels of the flexible bag for providing an opening in a predetermined portion of the tensioned side panel without releasing the tension in the remainder of the side panel. When the easy-opening device is activated the portion of the compressed flexible articles coinciding with the opening provided in the tensioned side panel expand through the opening in a fan-like array.

11 Claims, 4 Drawing Sheets

U.S. PATENT DOCUMENTS

| | | | |
|---|---|---|---|
| 3,172,564 | 3/1965 | Enloe et al. | 206/494 X |
| 3,173,188 | 3/1965 | Wexler | 28/1 |
| 3,174,644 | 3/1965 | Kaltman et al. | 221/302 |
| 3,206,105 | 9/1965 | Smith | 229/55 |
| 3,227,359 | 1/1966 | Hanlon | 229/66 |
| 3,327,449 | 6/1967 | Hullhorst et al. | 53/24 |
| 3,361,041 | 1/1968 | Grob | 93/8 |
| 3,370,630 | 2/1968 | Haugh et al. | 150/12 |
| 3,381,440 | 5/1968 | Hullhorst | 53/24 |
| 3,399,820 | 9/1968 | Foster et al. | 206/628 X |
| 3,514,033 | 5/1970 | Goodwin | 229/54 |
| 3,548,723 | 12/1970 | Sengewald | 93/35 |
| 3,593,622 | 7/1971 | Sengewald | 93/35 |
| 3,605,570 | 9/1971 | Goodwin | 93/35 |
| 3,626,656 | 12/1971 | Langenscheidt | 53/59 R |
| 3,660,964 | 5/1972 | Willis et al. | 53/125 |
| 3,729,886 | 5/1973 | Lucas et al. | 53/24 |
| 3,792,564 | 2/1974 | Brady, Jr. | 53/124 E |
| 3,818,673 | 6/1974 | Rollins et al. | 53/24 |
| 3,824,759 | 7/1974 | Finn et al. | 53/24 |
| 3,977,596 | 8/1976 | Gamble | 229/54 R |
| 4,031,815 | 6/1977 | Verbeke | 93/33 |
| 4,047,362 | 9/1977 | Lister et al. | 53/189 |
| 4,062,169 | 12/1977 | Lister et al. | 53/124 |
| 4,074,508 | 2/1978 | Reid | 53/62 |
| 4,182,237 | 1/1980 | O'Brien | 100/35 |
| 4,216,899 | 8/1980 | Kamp | 229/54 |
| 4,241,562 | 12/1980 | Meyer | 53/438 |
| 4,252,269 | 2/1981 | Peppiatt | 229/54 |
| 4,328,655 | 5/1982 | Spencer et al. | 53/439 |
| 4,414,788 | 11/1983 | Berg | 53/436 |
| 4,460,088 | 7/1984 | Rugenstein et al. | 206/494 |
| 4,501,107 | 2/1985 | Piotrowski | 53/438 |
| 4,539,705 | 9/1985 | Baines | 383/8 |
| 4,550,439 | 10/1985 | Peppiatt et al. | 383/8 |
| 4,573,203 | 2/1986 | Peppiatt | 383/8 |
| 4,577,453 | 3/1986 | Hofeler | 53/438 |
| 4,602,472 | 7/1986 | Ampolini et al. | 53/438 |
| 4,604,084 | 8/1986 | Pistner | 493/226 |
| 4,605,392 | 8/1986 | Achelpohl et al. | 493/196 |
| 4,607,388 | 8/1986 | Koiyumaki et al. | 383/121 |
| 4,608,808 | 9/1986 | Ryan et al. | 53/436 |
| 4,609,366 | 9/1986 | Ley et al. | 493/22 |
| 4,610,029 | 9/1986 | Huhtala et al. | 383/10 |
| 4,613,988 | 9/1986 | Maddock | 383/8 |
| 4,628,535 | 12/1986 | Tetenborg | 383/24 |
| 4,632,244 | 12/1986 | Landau | 206/219 |
| 4,633,649 | 1/1987 | Gautier et al. | 53/413 |
| 4,636,191 | 1/1987 | Piggott | 493/227 |
| 4,638,913 | 1/1987 | Howe, Jr. | 206/632 |
| 4,660,352 | 4/1987 | Deines et al. | 53/438 |
| 4,660,354 | 4/1987 | Lancaster et al. | 53/469 |
| 4,661,989 | 4/1987 | Risby | 383/2 |
| 4,664,957 | 5/1987 | van de Pol | 428/35 |
| 4,677,810 | 7/1987 | Spano | 53/428 |
| 4,685,276 | 8/1987 | Kiel | 53/459 |
| 4,686,815 | 8/1987 | Zils et al. | 53/469 |
| 4,688,369 | 8/1987 | Cornish et al. | 53/436 |
| 4,688,370 | 8/1987 | Dighton et al. | 53/469 |
| 4,688,372 | 8/1987 | Langen et al. | 53/529 |
| 4,691,368 | 9/1987 | Roessiger | 383/10 |
| 4,691,369 | 9/1987 | Costa | 383/17 |
| 4,694,638 | 9/1987 | Maddux, Jr. et al. | 53/459 |
| 4,696,050 | 9/1987 | Sengewald | 383/10 |
| 4,696,145 | 9/1987 | Schmidt et al. | 53/436 |
| 4,699,608 | 10/1987 | Pistner | 493/204 |
| 4,702,731 | 10/1987 | Lambrecht et al. | 493/196 |
| 4,703,517 | 10/1987 | Marino | 383/7 |
| 4,704,100 | 11/1987 | Kaufman | 493/194 |
| 4,706,440 | 11/1987 | Bittner | 53/438 |
| 4,710,967 | 12/1987 | Petschner | 383/8 |
| 4,711,066 | 12/1987 | Fox et al. | 53/436 |
| 4,711,067 | 12/1987 | Magni | 53/439 |
| 4,713,135 | 12/1987 | Bridgeford | 156/218 |
| 4,713,839 | 12/1987 | Peppiatt | 383/29 |
| 4,715,635 | 12/1987 | Koskinen | 294/68.1 |
| 4,717,262 | 1/1988 | Roen et al. | 383/120 |
| 4,720,872 | 1/1988 | Kaczerwaski | 383/8 |
| 4,721,396 | 1/1988 | Sengewald | 383/8 |
| 4,730,942 | 3/1988 | Fulcher | 383/7 |
| 4,730,943 | 3/1988 | Johnson | 383/8 |
| 4,738,078 | 4/1988 | Benz et al. | 53/439 |
| 4,738,546 | 4/1988 | Sengewald | 383/7 |
| 4,934,535 | 6/1990 | Muckenfuhs et al. | 206/610 |
| 4,966,286 | 10/1990 | Muckenfuhs | 206/610 |

Fig. 7
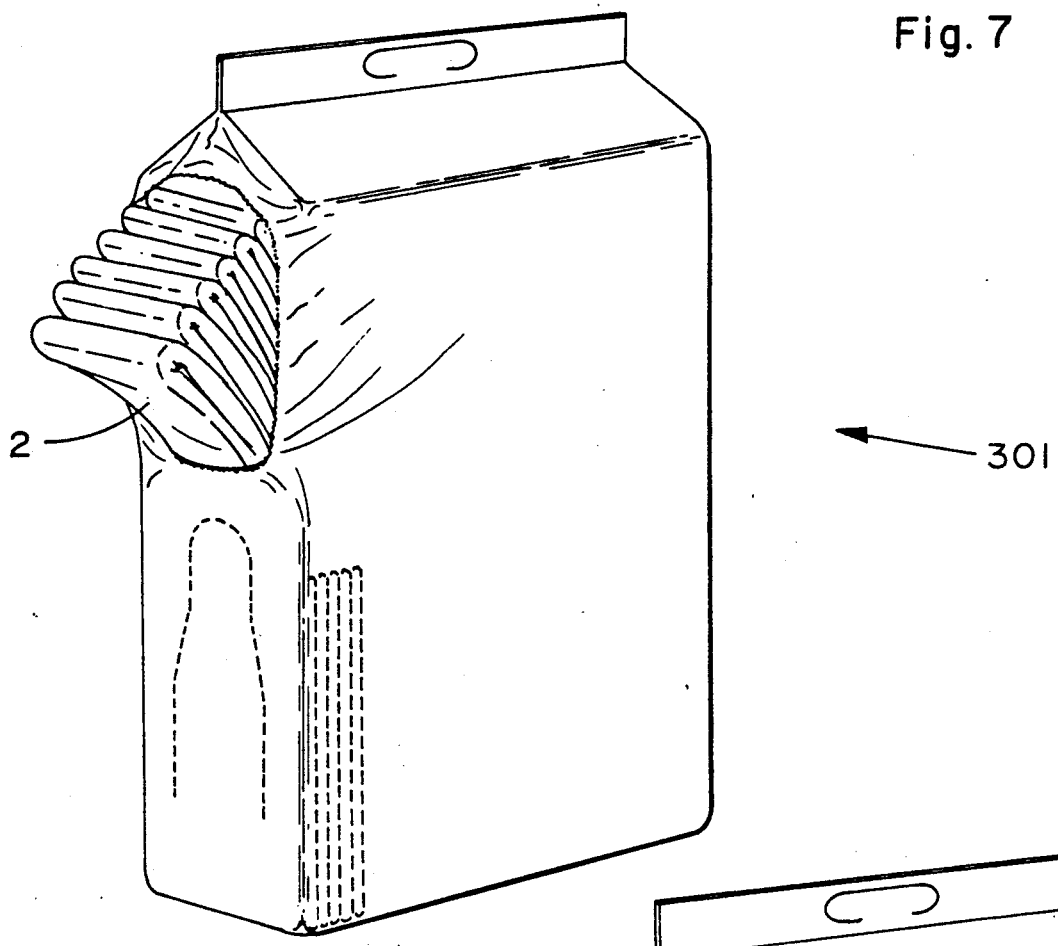
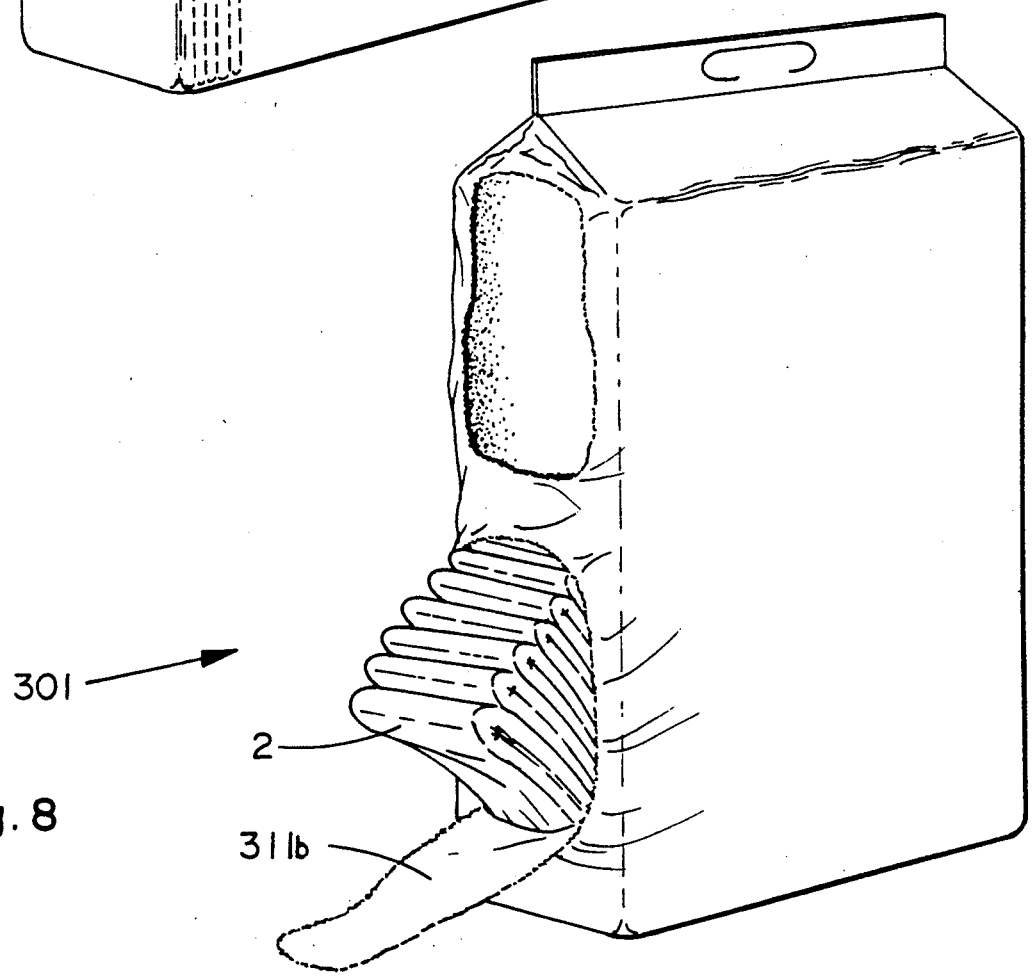
Fig. 8

OPENING DEVICE FOR FLEXIBLE BAGS FILLED WITH COMPRESSED FLEXIBLE ARTICLES

TECHNICAL FIELD

This invention relates to an opening device for flexible bags filled with compressed flexible articles. More particularly it relates to a pre-perforated opening device which can resist the tearing force the compressed flexible articles exert, without any need for reinforcing material, until the time opening of the bag is desired.

BACKGROUND ART

A polybag containing flexible articles and provided with an opening device and a carrying handle is disclosed in German patent application No. 3,629,563. The bag is more specifically provided for disposable diapers and a perforated opening device is provided in the top gusset of the filled bag, under the handle, so that individual articles can be taken out of the bag once the perforation is broken.

A flexible bag containing flexible articles which can be successively removed through an opening defined by a perforated front opening line, which extends preferably over about ⅓ of the front panel, is disclosed in German patent application No. 3,642,327. This front opening is enlarged further down as the articles are to be removed, so that the remaining articles are more or less protected until they are taken out. In order to prevent untimely tearing of the perforation line, a protective pull-away layer can be provided.

The bags described in the above art would not be suitable for delivering in a both convenient and orderly way truly compressed articles packed in them. The polybag of the art with the perforated opening device provided in the top gusset of the filled bag is unsuitable in that it does not allow easy removal of one of the compressed articles while leaving the remaining compressed articles in an undisturbed position. The same applies to the flexible bag showing a front opening device extending over about ⅓ of the front panel and which has to be gradually opened in order to enable successive removal of individual items. It is therefore an object of the present invention to provide an opening device for a flexible bag filled with compressed flexible articles, said opening device being resistant to the inside compression but still easy to operate, thereby allowing convenient and orderly access to the articles, while the remaining articles are still maintained within the bag in an orderly way.

SUMMARY OF THE INVENTION

The present invention relates to an opening device for flexible bags filled with compressed flexible articles, allowing convenient access to the contents and resisting the force of the inside compressed product during filling and handling operations without requiring the use of additional reinforcing materials. To achieve this, an opening device, defined by perforation lines, is provided on the bag panel perpendicular to the compression direction of the packed flexible articles. The perforation lines are so positioned that they are not directly subjected to the stretching force of the compressed flexible articles, so that no additional protective material is needed to prevent untimely tearing. A convenient feature for initiating tearing of the device along the perforation lines in order to get access to the articles is provided.

In a preferred embodiment, advantage is taken of one of the seams of the filled flexible bags to provide a convenient means for initiating opening of the device. In a further preferred embodiment, the opening device does not extend further down than 75% of the height of the panel on which it is provided. In a highly preferred embodiment, the flexible articles packed in the flexible bags equipped with the opening device according to the invention, are compressed to 50% of their initial volume.

BRIEF DESCRIPTION OF THE DRAWINGS

While the specification concludes with claims particularly pointing out and distinctly claiming the subject matter which is regarded as forming the present invention, it is believed that the invention will be better understood from the following descriptions which are taken in conjunction with the accompanying drawings in which like designations are used to designate substantially identical elements and in which:

FIG. 7 is a perspective view of the bag with opening devices and containing two superposed rows of articles represented in FIG. 6, with the opening device corresponding to the upper row of articles torn down and the articles ready to be pulled out.

FIG. 8 is a perspective view of the bag with opening devices and containing two superposed rows of articles represented in FIG. 6, but with the opening device corresponding to the lower row of articles torn down and the articles ready to be pulled out.

DETAILED DESCRIPTION OF THE DRAWINGS AND THE PREFERRED EMBODIMENTS

Figure 1:
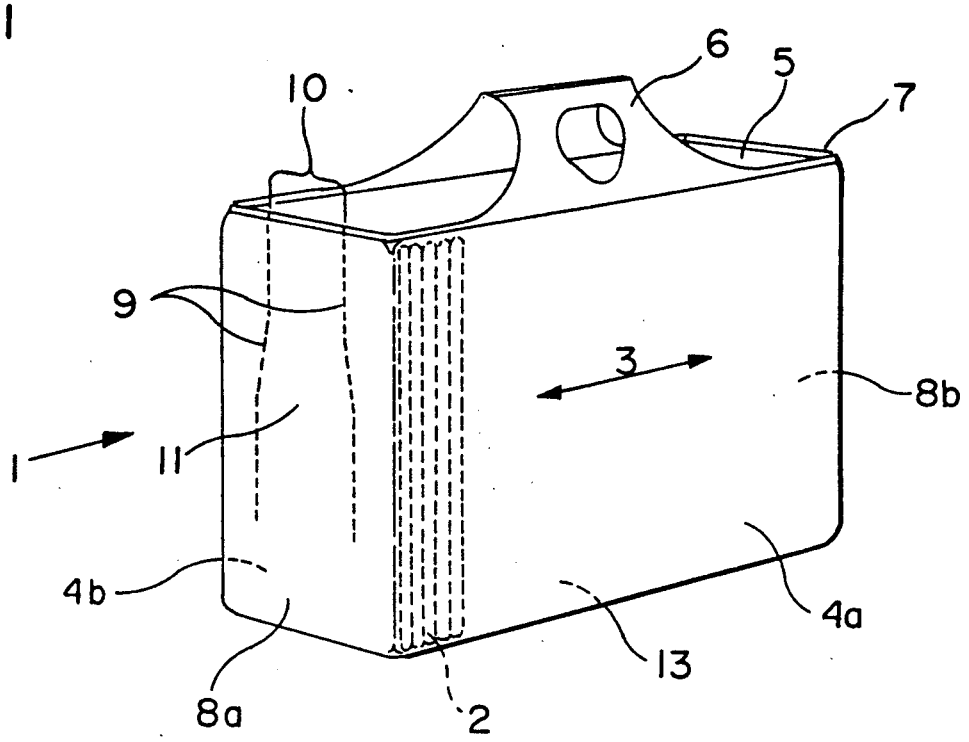
FIG. 1 is a perspective view of a preferred embodiment of the bag with opening device according to the invention, the opening device being provided on the bag panel perpendicular to the compression direction of the packed articles, the bag being of the top gusset type.

The filled bag of FIG. 1 is of the so-called top gusset type. In the present execution, this bag attains a substantially squared form (1) after filling with compressed articles (2) of which only a few are shown in dotted lines for illustration. The squared form consists of front panels (4*a* and 4*b*), side panels (8*a* and 8*b*), bottom panel (13), top panel (5), and carrying handle (6). The compressed articles (2) exert a stretching force onto the film in compression direction as indicated by arrows (3) on front panel (4*a*). Top panel (5) is provided with a carrying handle (6) and a seam (7) which surrounds and somewhat stands up over the plane of top panel (5). Side panel (8*a*) shows perforation lines (9) defining the potential area of accession to the articles, which corresponds to the opening device (11). Perforation lines (9) extend through the part of seam (7) bordering the edge between top panel (5) and side panel (8*a*), thereby defining a gripping zone (10).

Figure 2:
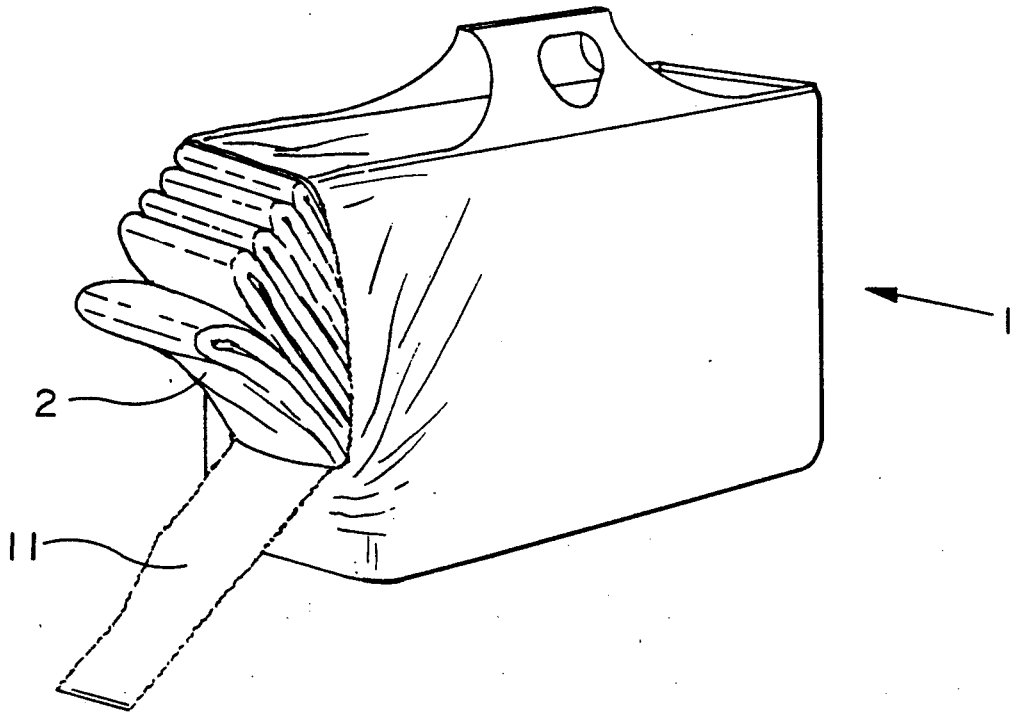
FIG. 2 is a perspective view of the bag with opening device represented in FIG. 1, but with the opening device torn down and the articles ready to be pulled out.

In FIG. 2 it can be seen how the opening device (11) is torn down and how the compressed articles (2) are released from bag (1).

Figure 3:
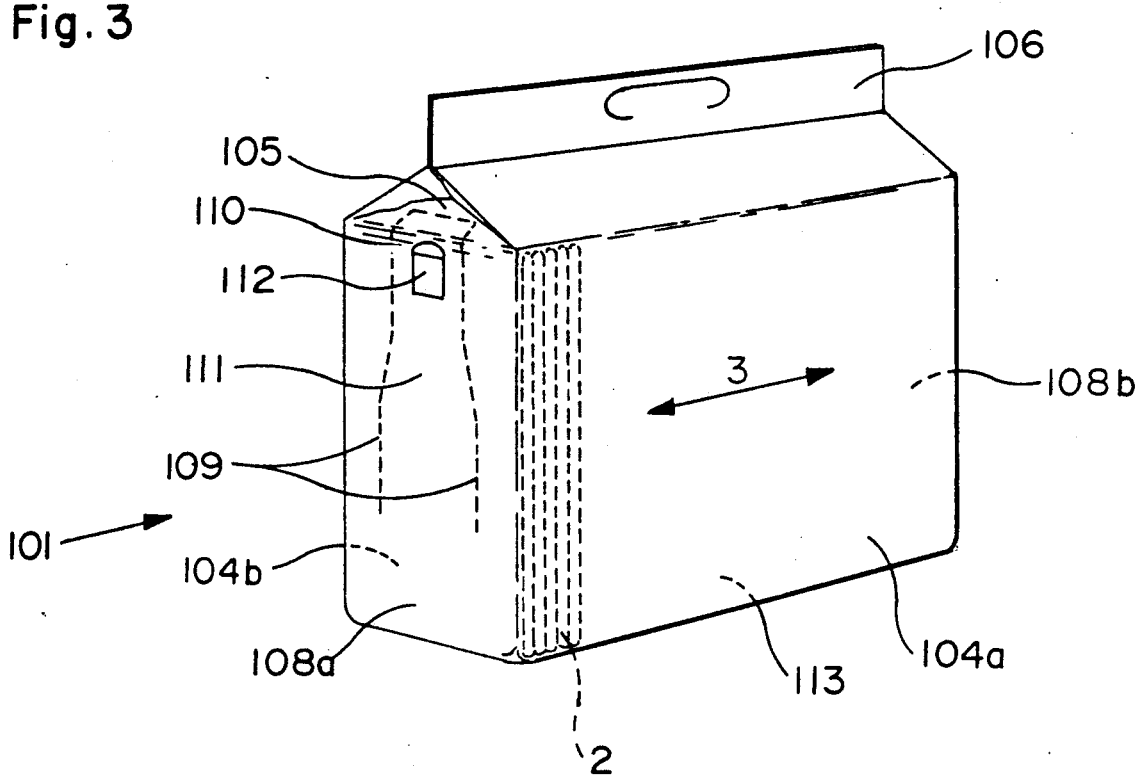
FIG. 3 is a perspective view of another preferred embodiment of the bag with opening device with grip tab according to the invention, provided on the bag panel perpendicular to the compression direction of the packed articles, the bag being of the side gusset type.
Figure 4:
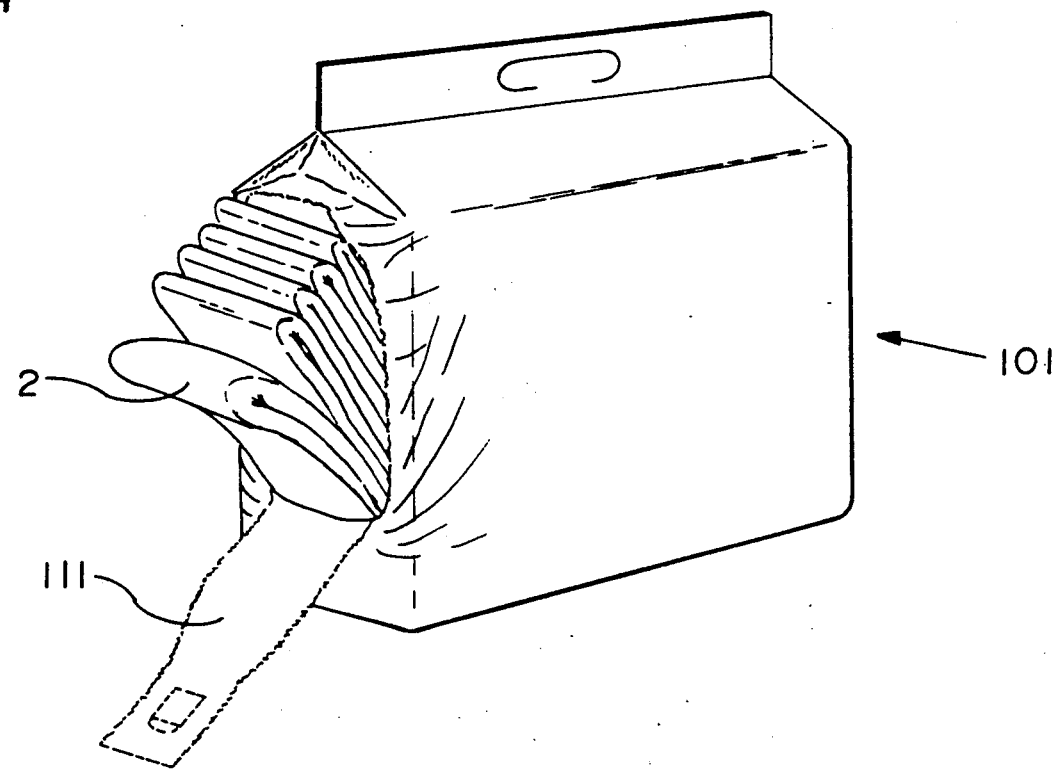
FIG. 4 is a perspective view of the bag with opening device represented in FIG. 4, but with the opening device torn down and the articles ready to be pulled out.

The preferred embodiment illustrated in FIGS. 3 and 4 is carried out in conjunction with a bag of the side gusset type.

As shown in FIG. 3, bag (101) has attained a substantially squared form after filling with compressed articles (2) of which, again, only a few are shown in dotted lines for illustration. The squared form consists of front panels (104*a* and 104*b*), side panels (108*a* and 108*b*), bottom panel (113), top panel (105), and carrying handle (106). The compressed articles (2) exert a stretching force onto the film in compression direction as indicated by arrows (3) on front panel (104*a*). Top panel (105) is provided with a carrying handle (106). Perforation lines (109) are provided in side panel (108*a*) and extend slightly into top panel (105). Opening device (111) is provided with a grip tab (112), applied in the viscinity of the area (110) of perforation lines reaching into the top panel (105).

FIG. 4 shows how, after opening device (111) has been torn down, compressed articles (2) are released from bag (101).

Figure 5:
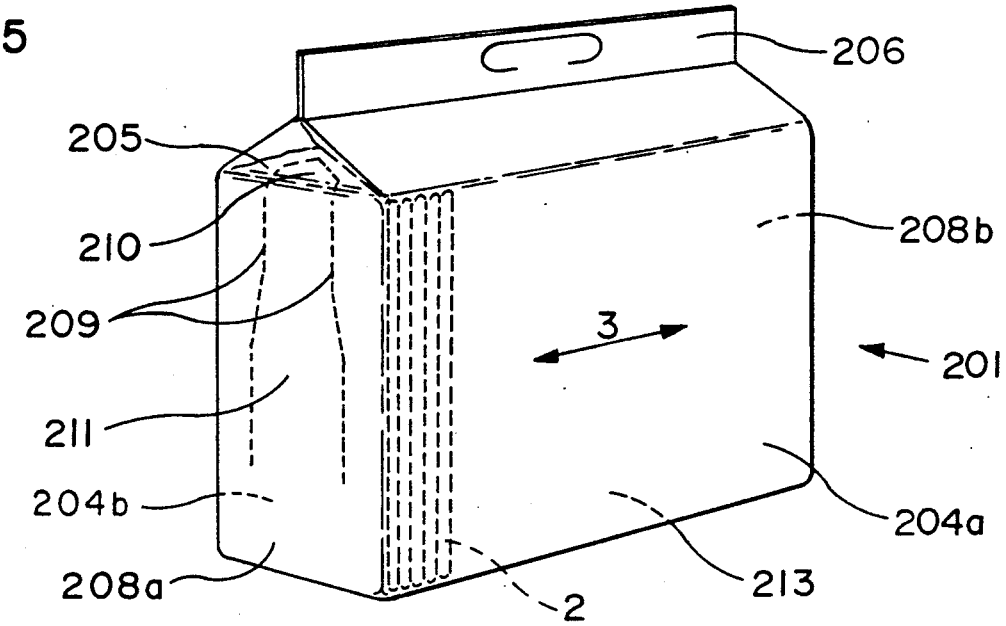
FIG. 5 is a perspective view of another preferred embodiment of the bag with opening device represented in FIG. 3 but without grip tab, the opening device being provided on the bag panel perpendicular to the compression direction of the packed articles, the bag being of the side gusset type.

The bag (201) of the preferred embodiment illustrated in FIG. 5 is also of the side gusset type. It differs from the bag illustrated in FIGS. 3 and 4 in that no grip tab is needed in order to tear down opening device (211). Indeed, the area of perforation lines (209) reaching into the top panel (205) are forming a small, rounded area (210) which can be easily ruptured by crushing with one finger to start tearing opening device (211) which, by tearing further down, allows access to the compressed articles (2).

Figure 6:
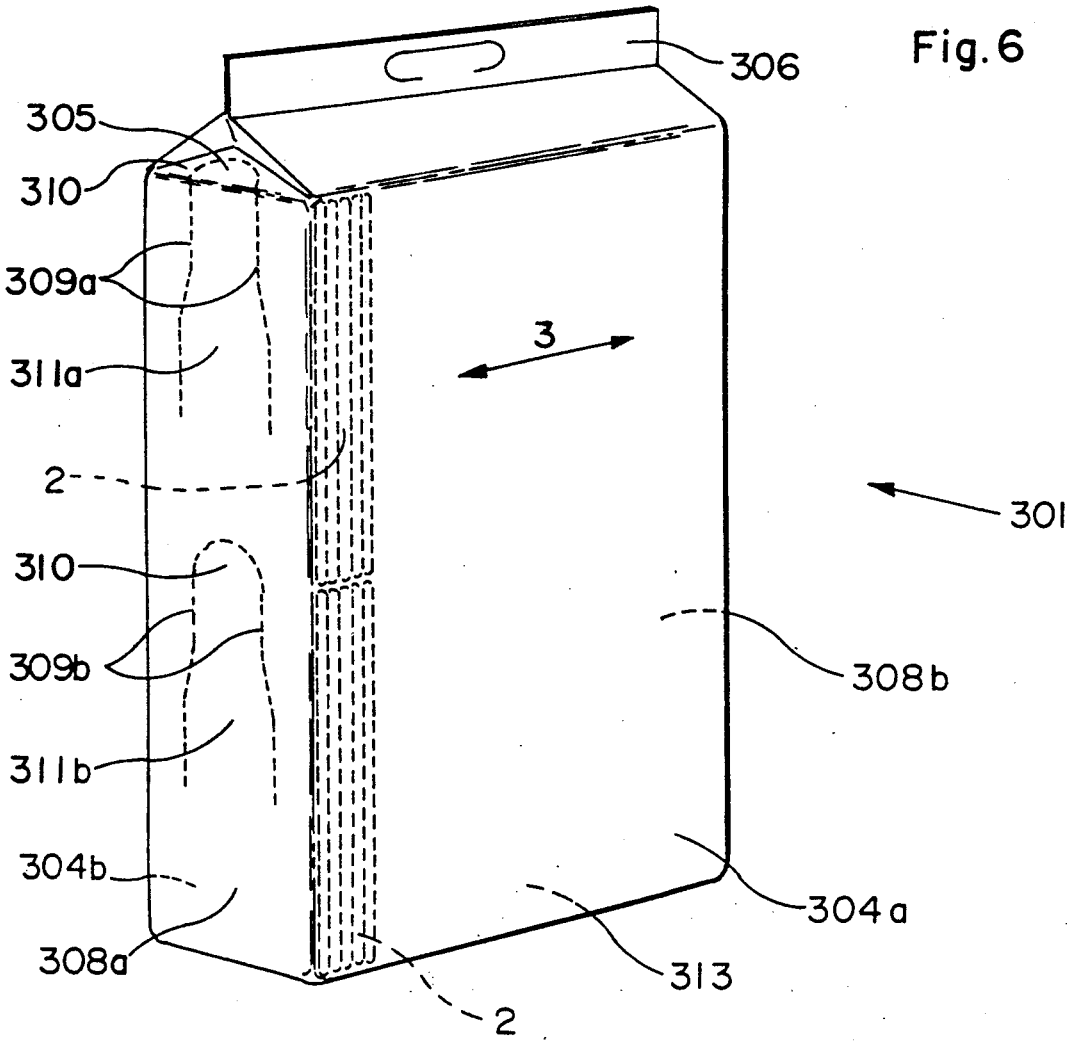
FIG. 6 is a perspective view of another preferred embodiment of the bag with opening device according to the invention, the opening device being provided on the bag panel perpendicular to the compression direction of the packed articles, the bag being of the side gusset type and containing two superposed rows of articles and consequently two opening devices.

FIGS. 6 to 8 illustrate a preferred embodiment carried out in conjunction with a bag of the side gusset type, but wherein two superposed rows of compressed articles (2) are packed.

FIG. 6 shows a bag (301) corresponding to the one described in FIG. 5, but with the exception that it is higher and contains two superposed rows of compressed articles (2). The opening device (311*a*) giving access to the upper row of articles is of the same type as the one described in FIG. 5. In order to give access to the lower row of articles, after at least a part of the upper row has been used, perforation lines (309), defining opening device (311*b*), are foreseen underneath opening device (311*a*) and are situated in such a way that small, rounded area (310) on the upper end of the device (311*b*) extends over the upper end of the lower row of compressed articles (2) so that it can be conveniently torn in order to give access to the lower row of compressed articles (2) after removing at least part of the upper row of compressed articles (2), by tearing down opening device 311*b*.

As an be clearly seen, FIG. 7 shows how upper row of compressed articles (2) is released from bag (301), as described in FIG. 6, after opening device (311*a*) has been torn out. FIG. 8 shows how compressed articles (2) are released from bag (301) after opening device (311*b*) has been torn down.

Opening devices according to the invention are especially advantageous for flexible bags filled with e.g. compressed disposable diapers. In a highly preferred embodiment, when the finished diapers reach the packing station, the stack to be packed in the bag is submitted to a 60% compression and inserted into the bag of the top gusset or side gusset type well-known to the man of the art, and subsequently sealed in a conventional way. At this stage the compressed stack of diapers has reached 50% of its original volume. The filled and sealed bag offers consequently quite a saving in storing and transportation space since the initial volume of the diapers has been reduced by 50%.

Since the compression exerts most of the stretching force on the film in the compression direction, it is possible to provide a perforated opening device perpendicular to this referred compression direction, without the need for protective materials to prevent the perforation from tearing apart due to the forces which the compressed diapers exert. By placing the perforation lines delimiting the opening device on the side panel opposite to stretching forces and at least 2 mm from the edge of the panel submitted to said forces, no protection of the perforation lines is needed, although this does not mean that e.g. a peel-off label showing usage instructions may not be provided within the scope of this invention.

It has been found that opening devices of a slightly tapered configuration are especially advantageous, the upper width ranging between 40% and 85% of the width of the side panel of the filled bag and the lower width ranging from 50% to 90% of the total width of the side panel of the filled bag. Tapered configurations are however not essential to the smooth operation of the device.

In order to allow the bag to continue its protective function for the unused articles to the best extent possible, it is preferable to extend the perforation lines defining the area of the opening device not further down than 75% of the height of the side panel of the filled bag. For easy access, a minimum height dimension of the opening device of 50% is preferred.

At the time the bag filled with the compressed articles is to be opened, the opening device is torn down by grabbing either the gripping zone (10) or grip tape (112), thereby releasing part of the compression force inside the bag. This release allows the first article to come forward and be easily removed from the bag, the subsequent article coming thereafter automatically forward due to the compression force which is gradually released. As each article comes forward and is removed, the compression force inside the bag obviously decreases. Since the initial compression was, however, of 50%, the opening device according to the invention acts as a dispenser for at least 50% of the contents of the bag. Removal of the remaining articles is easy since they will have regained their uncompressed condition. The fact that the opening device does not extend further down than 75% of the height of the side panel combined with the compression force existing within the bag, even after opening, prevents the remaining articles from falling out of the bag, even if the bag is moved around.

It has been found that the opening device according to the invention works also vary well when the flexible articles are submitted to a lower compression, i.e. between 1.5% and 4.5%, the only difference being that a smaller proportion of the compressed flexible articles will come forward one after the other, as articles are removed. This is however not a problem, since the remaining articles are still easily accessible.

Although the preferred embodiments show an execution in which only one row or two superposed rows of articles are packed, it is also possible to pack more than one row of articles, positioned side by side, each row or articles being accessible through an opening device as described hereabove.

It is also possible to equip squared bag 1 with a grip tab (112), in addition to or rather than to take advantage of the coinciding portion of seam (7).

The bag can be made of any flexible material, like different types of plastic film, paper, or any combination of those.

Although four preferred embodiments have been described in detail and illustrated in the drawings, many variations are possible which still fall within the scope of the claimed invention.

We claim:

1. An easy-open flexible bag filled with compressed flexible articles, each of said articles having a width, a length and a thickness, said bag having a substantially rectangular form after filling with said flexible articles which have been compressed in a direction substantially parallel to their thickness, said rectangular form comprising a pair of opposed front panels, each of said front panels having uppermost and lowermost edges, interconnected to a pair of opposed side panels, each of said panels having uppermost and lowermost edges, said side panels being oriented substantially perpendicular to the direction compression of said flexible articles, a bottom panel connected to the lowermost edges of said front panels and said side panels and a top panel connected to the uppermost edges of said front panels and said side panels, said interconnected front panels and side panels being subject to tension induced by said compressed flexible articles, said flexible bag further including an easy-opening device provided on one of said tensioned side panels of said flexible bag for providing an opening in a predetermined portion of said tensioned side panel without releasing the tension in the remainder of said side panel, whereupon the portion of said compressed flexible articles coinciding with the opening provided in said side panel expand through said opening in a fan-like array when said easy-opening device is activated.

2. The easy-open flexible bag of claim 1, including a carrying handle secured to each of said opposed front panels.

3. The easy-open flexible bag of claim 1, wherein said flexible bag is comprised of a material selected from the group consisting of plastic film, paper and laminate structures comprised of a combination of the aforementioned materials.

4. The easy-open flexible bag of claim 1, wherein said easy-opening device comprises perforation lines provided on said tensioned side panel to define said opening.

5. The easy-open flexible bag of claim 4, wherein said perforation lines extend slightly into said top panel where they define a predetermined area and wherein said opening device is provided with a grip tab applied in the vicinity of said predetermined area.

6. The easy-open flexible bag of claim 4, wherein at least two of the perforation lines in said tensioned side panel are oriented generally vertically and wherein said generally vertically oriented perforation lines do not extend more than about 75% of the height of said tensioned side panel.

7. The easy-open flexible bag of claim 6, wherein the opening formed in said tensioned side panel when said opening device is activated is widest near the bottom panel of said flexible bag and tapers slightly inwardly in the direction of the top panel of said flexible bag.

8. An easy-open flexible bag filled with compressed flexible articles, each of said articles having a width, a length and a thickness, said bag having a substantially rectangular form after filling with said articles which have been compressed in a direction substantially parallel to their thickness, said rectangular form comprising a pair of opposed front panels, each of said front panels having uppermost and lowermost edges, interconnected to a pair of opposed side panels, each of said side panels having uppermost and lowermost edges, said side panels being oriented substantially perpendicular to the direction of compression of said flexible articles, a bottom panel connected to the lowermost edges of said front panels and said side panels and a top panel connected to the uppermost edges of said front panels and said side panels, said top panel being surrounded by a seam which projects upwardly above said top panel, said interconnected front panels and side panels being subject to tension induced by said compressed flexible articles, said flexible bag further including an easy-opening device provided on one of said tensioned side panels of said flexible bag for providing an opening in a predetermined portion of said tensioned side panel without releasing the tension in the remainder of said side panel, said easy-opening device comprising upwardly oriented perforation lines provided on said tensioned side panel to define said opening, said upwardly oriented perforation lines provided on said tensioned side panel also extending through said upwardly projecting seam and thereby defining a gripping zone for said easy-opening device in said upwardly projecting seam, whereupon the portion of said compressed flexible articles coinciding with the opening provided in said side panel expand through said opening in a fan-like array when said easy-opening device is activated.

9. An easy-open flexible bag filled with compressed flexible articles, each of said articles having a width, a length and a thickness, said bag having a substantially rectangular form after filling with said flexible articles which have been compressed in a direction substantially parallel to their thickness, said flexible articles packed in said substantially rectangular flexible bag exhibiting a degree of compression of up to about 50% as compared to their initial uncompressed thickness prior to insertion within said bag, said rectangular form comprising a pair of opposed front panels, each of said front panels having uppermost and lowermost edges, interconnected to a pair of opposed side panels, each of said side panels having uppermost and lowermost edges, said side panels being oriented substantially perpendicular to the direction of compression of said flexible articles, a bottom panel connected to the lowermost edges of said front panels and said side panels and a top panel connected to the uppermost edges of said front panels and said side panels, said interconnected front panels and side panels being subject to tension induced by said compressed flexible articles, said flexible bag further including an easy-opening device provided on one of said tensioned side panels of said flexible bag for providing an opening in a predetermined portion of said tensioned side panel without releasing the tension in the remainder of said side panel, whereupon the portion of said compressed flexible articles coinciding with the opening provided in said side panel expand through said opening in a fan-like array when said easy-opening device is activated.

10. An easy-open flexible bag filled with compressed flexible articles each of said articles having a width, a length and a thickness, said bag having a substantially rectangular form after filling with said flexible articles which have been compressed in a direction substantially parallel to their thickness, said flexible articles packed in said substantially rectangular flexible bag exhibiting a degree of compression of up to about 50% as compared to their initial uncompressed thickness prior to insertion within said bag, said rectangular form comprising a pair of opposed front panels, each of said front panels having uppermost and lowermost edges, interconnected to a pair of opposed side panels, each of said side panels having uppermost and lowermost edges, said side panels being oriented substantially perpendicular to the direction of compression of said flexible articles, a bottom panel connected to the lowermost edges of said front panels and said side panels and a top panel connected to the uppermost edges of said front panels and said side panels, said easy-open flexible bag further including a carrying handle secured to each of said opposed front panels, said interconnected front panels and side panels being subject to tension induced by said compressed flexible articles, said flexible bag further including an easy-opening device provided on one of said tensioned side panels of said flexible bag for providing an opening in a predetermined portion of said tensioned side panel without releasing the tension in the remainder of said side panel, whereupon the portion of said compressed flexible articles coinciding with the opening provided in said side panel expand through said opening in a fan-like array when said easy-opening device is activated.

11. An easy-open flexible bag filled with compressed flexible articles each of said articles having a width, a length and a thickness, said bag having a substantially rectangular form after filling with said flexible articles which have been compressed in a direction substantially parallel to their thickness, said flexible bag being comprised of a material selected from the group consisting of plastic film, paper and laminate structures comprised of a combination of the aforementioned materials, said flexible articles packed in said substantially rectangular flexible bag exhibiting a degree of compression of up to about 50% as compared to their initial uncompressed thickness prior to insertion within said bag, said rectangular form comprising a pair of opposed front panels, each of said front panels having uppermost and lowermost edges, interconnected to a pair of opposed side panels, each of said side panels having uppermost and lowermost edges, said side panels being oriented substantially perpendicular to the direction of compression of said flexible articles, a bottom panel connected to the lowermost edges of said front panels and said side panels and a top panel connected to the uppermost edges of said front panels and said side panels, said interconnected front panels and side panels being subject to tension induced by said compressed flexible articles, said flexible bag further including an easy-opening device provided on one of said tensioned side panels of said flexible bag for providing an opening in a predetermined portion of said tensioned side panel without releasing the tension in the remainder of said side panel, whereupon the portion of said compressed flexible articles coinciding with the opening provided in said side panel expand through said opening in a fan-like array when said easy-opening device is activated.

* * * * *

UNITED STATES PATENT AND TRADEMARK OFFICE

CERTIFICATE OF CORRECTION

PATENT NO. : 5,036,978

DATED : August 6, 1991

INVENTOR(S) : Martin Frank, Agustin Ramos

It is certified that error appears in the above-identified patent and that said Letters Patent is hereby corrected as shown below:

Column 3, line 41, "viscinity" should read -- vicinity -- .

Column 4, line 10, "an" should read -- can -- .

Column 5, line 12, "vary" should read -- very -- .

Column 5, line 22, "or" should read -- of -- .

Column 5, line 45, before "panel" insert -- side -- .

Signed and Sealed this

First Day of December, 1992

*Attest:*

*Attesting Officer*

DOUGLAS B. COMER

*Acting Commissioner of Patents and Trademarks*